US010481515B2

(12) United States Patent
Kuwabara et al.

(10) Patent No.: US 10,481,515 B2
(45) Date of Patent: Nov. 19, 2019

(54) CHARGING DEVICE, PROCESS CARTRIDGE, AND IMAGE FORMING APPARATUS

(71) Applicants: Nobuo Kuwabara, Kanagawa (JP); Daisuke Tomita, Kanagawa (JP); Norio Kudoh, Kanagawa (JP); Kento Aoki, Kanagawa (JP); Takeshi Fukao, Kanagawa (JP)

(72) Inventors: Nobuo Kuwabara, Kanagawa (JP); Daisuke Tomita, Kanagawa (JP); Norio Kudoh, Kanagawa (JP); Kento Aoki, Kanagawa (JP); Takeshi Fukao, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/267,996

(22) Filed: Feb. 5, 2019

(65) Prior Publication Data

US 2019/0258188 A1 Aug. 22, 2019

(30) Foreign Application Priority Data

Feb. 16, 2018 (JP) ..... 2018-025739

(51) Int. Cl.
*G03G 15/02* (2006.01)
*G03G 21/18* (2006.01)

(52) U.S. Cl.
CPC ..... *G03G 15/0225* (2013.01); *G03G 21/1814* (2013.01)

(58) Field of Classification Search
CPC ..... G03G 15/0225; G03G 21/1814
See application file for complete search history.

(56) References Cited

U.S. PATENT DOCUMENTS 5,697,020 A * 12/1997 Sato ..... G03G 15/0216 361/225
2005/0271420 A1 12/2005 Arai et al.
2006/0115292 A1* 6/2006 Sampe ..... G03G 15/0225 399/100
2007/0098435 A1* 5/2007 Kitagawa ..... F16C 13/02 399/100
2008/0003012 A1* 1/2008 Ozawa ..... G03G 15/0225 399/100
2015/0147083 A1 5/2015 Uenishi et al.
2015/0160587 A1 6/2015 Seki et al.
(Continued)

FOREIGN PATENT DOCUMENTS

JP 09179384 A * 7/1997
JP 2006337536 A * 12/2006
(Continued)

*Primary Examiner* — Susan S Lee
(74) *Attorney, Agent, or Firm* — Duft & Bornsen, PC

(57) ABSTRACT

A charging device is detachably attachable with respect to a body of an image forming apparatus. The charging device includes a charging roller and a cleaning member. The charging roller charges an image bearer. The cleaning member cleans the charging roller. The cleaning member has a higher cleaning performance on the charging roller during detachment in which the charging device is detached from the body of the image forming apparatus than during attachment in which the charging device is attached to the body of the image forming apparatus.

16 Claims, 5 Drawing Sheets

(56) References Cited

U.S. PATENT DOCUMENTS

| | | | |
|---|---|---|---|
| 2015/0248075 | A1 | 9/2015 | Seki et al. |
| 2016/0195830 | A1 | 7/2016 | Seki et al. |
| 2016/0209771 | A1 | 7/2016 | Maehata et al. |

FOREIGN PATENT DOCUMENTS

| | | |
|---|---|---|
| JP | 2008-040433 | 2/2008 |
| JP | 2008-304764 | 12/2008 |
| JP | 2009-175698 | 8/2009 |
| JP | 2018-112722 | 7/2018 |

* cited by examiner

CHARGING DEVICE, PROCESS CARTRIDGE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-025739, filed on Feb. 16, 2018, in the Japan Patent Office, the entire disclosure of which is incorporated by reference herein.

BACKGROUND

Technical Field

Aspects of the present disclosure relate to an image forming apparatus using an electrophotography method, such as a copying machine, a printer, a facsimile machine, or a multifunction peripheral of the aforementioned machines, and a charging device and a process cartridge installed in the image forming apparatus.

Related Art

In an image forming apparatus such as a copying machine or a printer, a technology of installing a cleaning member that cleans a charging roller that charges a photoconductor drum (image bearer) is known.

SUMMARY

In an aspect of the present disclosure, there is provided a charging device that is detachably attachable with respect to a body of an image forming apparatus. The charging device includes a charging roller and a cleaning member. The charging roller charges an image bearer. The cleaning member cleans the charging roller. The cleaning member has a higher cleaning performance on the charging roller during detachment in which the charging device is detached from the body of the image forming apparatus than during attachment in which the charging device is attached to the body of the image forming apparatus.

In another aspect of the present disclosure, there is provided a process cartridge that is detachably attached with respect to the body of the image forming apparatus. The process cartridge includes the above-described charging device and the image bearer.

In still another aspect of the present disclosure, there is provided an image forming apparatus comprising the above-described charging device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
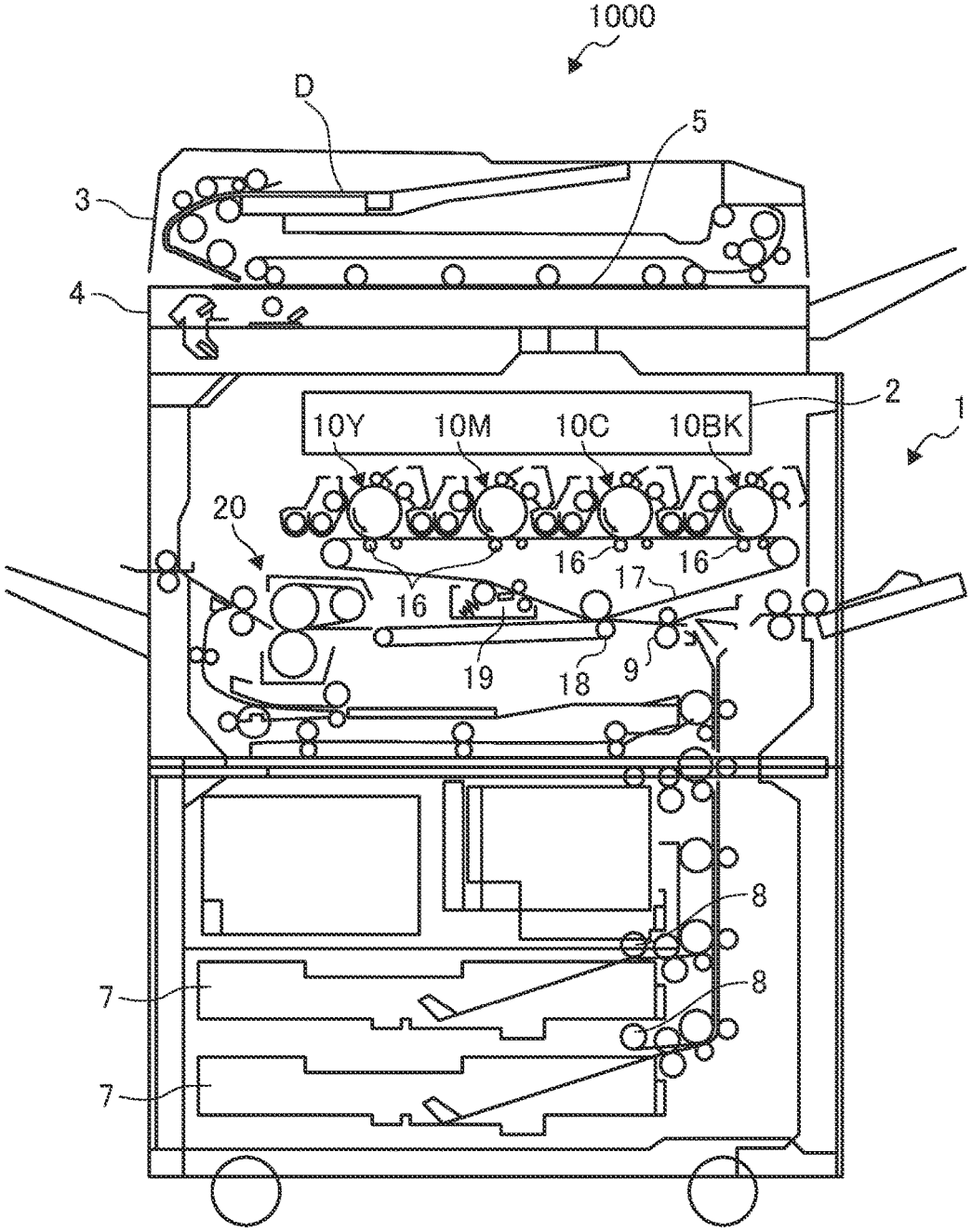
FIG. 1 is a general arrangement diagram illustrating an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Hereinafter, modes for carrying out the present invention will be described in detail with reference to the drawings. In the drawings, the same or corresponding parts are denoted by the same reference numerals, and redundant description will be simplified or omitted as appropriate.

First, overall configuration and operation of an image forming apparatus 1 will be described with reference to FIGS. 1 and 2.

FIG. 1 is a general arrangement diagram illustrating an image forming apparatus according to an embodiment. FIG. 2 is a cross-sectional view illustrating a configuration of a process cartridge 10Y (image former) for yellow installed in the image forming apparatus 1 of FIG. 1.

Figure 2:
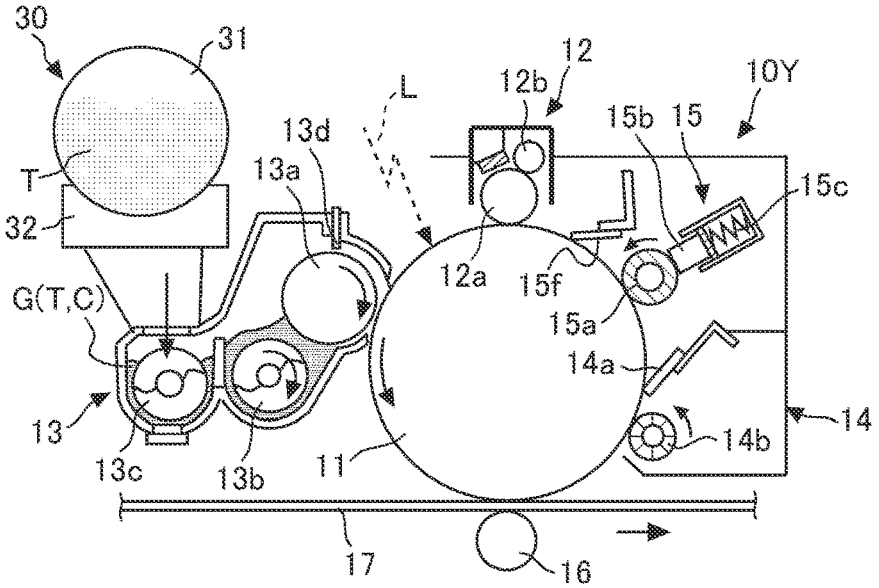
FIG. 2 is a configuration diagram illustrating an image former.

Since four process cartridges 10Y, 10M, 10C, and 10BK (image formers) have almost the same structure except for colors of toners T used in an image forming process, FIG. 2 illustrates the process cartridge 10Y for yellow as a representative process cartridge.

In FIG. 1, the image forming apparatus 1 illustrated as a tandem color copying machine includes a writing device 2 to emit laser light based on input image information, a document feeder 3 to feed a document D to a document reader 4, the document reader 4 to read image information of the document D, a sheet feeder 7 in which sheets such as paper sheets are accommodated, and paired registration rollers 9 to adjust sheet feed timing.

Further, FIG. 1 illustrates process cartridges 10Y, 10M, 10C, and 10BK in which toner images of respective colors (yellow, magenta, cyan, and black) are formed, and primary transfer rollers 16 to superimpose and transfer the toner images formed on photoconductor drums of the process cartridges 10Y, 10M, 10C, and 10BK onto an intermediate transfer belt 17.

The image forming apparatus 1 further includes the intermediate transfer belt 17 onto which toner images in a plurality of colors are superimposed and transferred, a secondary transfer roller 18 to transfer the toner images on the intermediate transfer belt 17 onto a sheet, an intermediate transfer belt cleaner 19 to clean the intermediate transfer belt 17, and a fixing device 20 to fix the toner images (unfixed images) on the sheet.

Hereinafter, the operation at the time of forming a normal color image in the image forming apparatus will be described.

First, the document D is fed from a document table by a feed roller of the document feeder 3 and is placed on an exposure glass 5 of the document reader 4. Then, the document reader 4 optically reads image information of the document D placed on the exposure glass 5.

Specifically, the document reader 4 scans an image of the document D on the exposure glass 5 while irradiating the document D with light emitted from an illumination lamp. Then, the light reflected by the document D is imaged on a color sensor via a mirror group and a lens. Color image information of the document D is read for each color separation light of red, green, and blue (RGB) by the color sensor and is then converted into electrical image signals. Further, an image processor performs processing such as color conversion processing, color correction processing, and spatial frequency correction processing on the basis of the RGB color separation image signals to obtain color image information of yellow, magenta, cyan, and black.

Then, the image information of the respective colors of yellow, magenta, cyan, and black is transmitted to the writing device 2. Then, the writing device 2 emits laser light L (exposure light) based on the image information of the respective colors toward photoconductor drums 11 (image bearers) of the corresponding process cartridges 10Y, 10M, 10C, and 10BK.

Meanwhile, the photoconductor drums 11 (see FIG. 2) of the four process cartridges 10Y, 10M, 10C, and 10BK rotate in a predetermined direction (counterclockwise direction). Then, first, a surface of the photoconductor drum 11 is uniformly charged (charging process) at a portion facing a charging device 12 (charging roller 12*a*). In this way, a charged potential (about −900 V) is formed on the photoconductor drum 11. After that, the surface of the charged photoconductor drum 11 reaches an irradiation position of each laser light L.

In the writing device 2, the laser light L corresponding to the image signals is emitted from four light sources corresponding to the respective colors. Each laser light L passes through a different optical path for each color component of yellow, magenta, cyan, or black (exposure process).

The laser light L corresponding to the yellow component is emitted on the surface of the first photoconductor drum 11 (image bearer) from the left side of the drawing. At this time, the laser light of the yellow component is scanned in a rotation axis direction (main scanning direction) of the photoconductor drum 11 by a high-speed rotating polygon mirror. In this way, an electrostatic latent image (an exposure potential of about −50 to 100 V) corresponding to the yellow component is formed on the photoconductor drum 11 charged by the charging device 12.

Similarly, the laser light corresponding to the magenta component is emitted on the surface of the second photoconductor drum 11 from the left in the drawing, and an electrostatic latent image corresponding to the magenta component is formed. The laser light of the cyan component is emitted on the surface of the third photoconductor drum 11 from the left in the drawing, and an electrostatic latent image of the cyan component is formed. The laser light of the black component is emitted on the surface of the fourth photoconductor drum 11 from the left in the drawing, and an electrostatic latent image of the black component is formed.

After that, the surfaces of the photoconductor drums 11 on which the electrostatic latent images of the respective colors are formed reach positions facing developing devices 13, respectively. Then, toners of the respective colors are supplied from the respective developing devices 13 onto the photoconductor drums 11, and the latent images on the photoconductor drums 11 are developed to form toner images (developing process).

After that, the surfaces of the photoconductor drums 11 after the developing process reach portions (primary transfer nips) facing the intermediate transfer belt 17, respectively. Here, primary transfer rollers 16 are provided in contact with an inner peripheral surface of the intermediate transfer belt 17 at the respective portions facing the intermediate transfer belt 17. Then, the toner images of the respective colors formed on the photoconductor drums 11 are sequentially superimposed and transferred onto the intermediate transfer belt 17 at the positions of the primary transfer rollers 16 (primary transfer process).

Then, each of the surfaces of the photoconductor drums 11 after the primary transfer process reaches a position facing a cleaning device 14 (cleaning portion) after passing through the position of a neutralization device. Then, at the position, an untransferred toner remaining on the photoconductor drum 11 is mechanically removed by a cleaning blade 14*a* and a cleaning brush roller 14*b*, and the removed untransferred toner is collected in the cleaning device 14 (cleaning process). The untransferred toner collected in the cleaning device 14 is conveyed to the outside of the cleaning device 14 by a conveying screw and collected as a waste toner inside a waste toner collection container.

After that, the surface of the photoconductor drum 11 passes the position of a lubricant supply device 15, and the series of image forming processes on the photoconductor drum 11 is terminated.

Meanwhile, the intermediate transfer belt 17 on which the toners of the respective colors on the photoconductor drums 11 are superimposed and transferred (born) travels in a clockwise direction in FIG. 1, and reaches a position (secondary transfer nip) facing the secondary transfer roller 18. Then, a color toner image born on the intermediate transfer belt 17 is transferred onto the sheet at the position facing the secondary transfer roller 18 (secondary transfer process).

After that, the surface of the intermediate transfer belt 17 reaches the position of the intermediate transfer belt cleaner 19. Then, the untransferred toner adhering to the intermediate transfer belt 17 is collected by the intermediate transfer belt cleaner 19, and the series of transfer processes on the intermediate transfer belt 17 is terminated.

Here, the sheet conveyed between the intermediate transfer belt 17 and the secondary transfer roller 18 (the secondary transfer nip) is conveyed from the sheet feeder 7 via the registration roller 9 and the like.

Specifically, the sheet fed by a sheet feeding roller 8 from the sheet feeder 7 in which sheets such as papers are accommodated is guided to the registration roller 9 (timing roller) via a conveying path. The sheet having reached the registration roller 9 is timely conveyed to the secondary transfer nip.

Then, the sheet to which the full-color image has been transferred is guided to the fixing device 20 by a conveyance belt. In the fixing device 20, the color image (toner) is fixed on the sheet at a nip between a fixing belt and a pressure roller.

Then, the sheet after a fixing process is discharged as an output image to the outside of the body of the image forming apparatus 1 by a sheet ejection roller, and the series of image forming processes is completed.

Next, the process cartridge 10Y will be described in detail with reference to FIG. 2. As illustrated in FIG. 2, the process cartridge 10Y has the photoconductor drum 11 as an image bearer, the charging device 12 (charging unit), the developing device 13, the cleaning device 14, and the lubricant supply device 15 integrally configured as a unit. The process cartridge 10Y is attachably and detachably (replaceably) installed with respect to the body of the image forming apparatus 1, and is appropriately detached from the body of the image forming apparatus 1 and replaced with a new one or repaired.

Here, the photoconductor drum 11 as an image bearer is a negatively chargeable organic photoconductor provided with a photoconductor layer or the like on a drum-like conductive support.

In the photoconductor drum 11, an undercoat layer that is an insulating layer, a charge generation layer and a charge transport layer as the photoconductor layer, and a surface layer (protective layer) are sequentially stacked on the conductive support as a base layer. The photoconductor drum 11 is rotationally driven in a counterclockwise direction in FIG. 2 by a main motor.

Referring to FIGS. 2 to 4, the charging device 12 includes the charging roller 12*a*, a cleaning roller 12*b*, a cleaning pad 12*c*, an operating member 12*d*, a gear 12*h*, a casing 12*e*, a movable plate 12*f*, and the like.

The charging roller 12*a* is a roller member formed by coating an outer periphery of a conductive cored bar with a resin layer with medium resistance and is disposed downstream of the lubricant supply device 15 in a rotating direction of the photoconductor drum 11. Further, the charging roller 12*a* is disposed such that a roller portion of the charging roller 12*a* comes into contact with the photoconductor drum 11 (image bearer) in a longitudinal direction. Then, a predetermined voltage (charging bias) is applied from a power supply (high voltage power supply) to the charging roller 12*a*, so that the charging roller 12*a* uniformly charges the surface of the facing photoconductor drum 11.

The cleaning roller 12*b* and the cleaning pad 12*c* function as cleaning members to remove (clean) dirt on the surface of the charging roller 12*a*. The cleaning roller 12*b* and the cleaning pad 12*c* will be described below in detail together with other members.

Referring to FIG. 2, the developing device 13 mainly includes a developing roller 13*a* facing the photoconductor drum 11, a first conveying screw 13*b* facing the developing roller 13*a*, a second conveying screw 13*c* facing the first conveying screw 13*b* via a partitioning member, and a doctor blade 13*d* facing the developing roller 13*a*. The developing roller 13*a* includes a magnet secured inside and forming a magnetic pole on a peripheral surface of the roller, and a sleeve rotating around the magnet. A plurality of magnetic poles is formed on the developing roller 13*a* (sleeve) by the magnet, and a developer G is born on the developing roller 13*a*. In the developing device 13, a two-component developer G containing a carrier C and a toner T is accommodated.

In the cleaning device 14, the cleaning blade 14*a* to come into contact with and clean the surface of the photoconductor drum 11, and the cleaning brush roller 14*b* to rotate in a predetermined direction while being in contact with the surface of the photoconductor drum 11 to clean the surface of the photoconductor drum 11 are installed.

The untransferred toner adhering to the photoconductor drum 11 (the untransferred toner including paper dust generated from the sheet, discharge products generated on the photoconductor drum 11 at the time of discharge by the charging device 12, additives added to the toner, a lubricant supplied from the lubricant supply device 15, and the like) is mechanically scraped off by the cleaning blade 14*a* and the cleaning brush roller 14*b*, and is collected inside the cleaning device 14.

The lubricant supply device 15 includes a lubricant supply roller 15*a* peripherally provided with a foamed elastic layer (or a brush having fibers woven into a sheet base material) in sliding contact with the photoconductor drum 11 and to supply the lubricant onto the photoconductor drum 11, a solid lubricant 15*b* in sliding contact with the lubricant supply roller 15*a*, a compression spring 15*c* to urge the solid lubricant 15*b* toward the lubricant supply roller 15*a*, and a thin layer forming blade 15*f* to be in contact with the photoconductor drum 11 and make the lubricant supplied on the photoconductor drum 11 thin (uniform), and the like.

The lubricant supply device 15 is disposed downstream of the cleaning device 14 (cleaning blade 14*a*) in the rotating direction of the photoconductor drum 11, and upstream of the charging device 12 in the rotating direction of the photoconductor drum 11. Further, the thin layer forming blade 15*f* is disposed downstream of the lubricant supply roller 15*a* in the rotating direction of the photoconductor drum 11.

The lubricant supply device 15 configured as described above supplies the lubricant to the surface of the photoconductor drum 11. Specifically, the lubricant is scraped off from the solid lubricant 15*b* with the rotation of the lubricant supply roller 15*a*, and is applied on the photoconductor drum 11 by the lubricant supply roller 15*a*. As a result, abrasion deterioration of members such as the cleaning blade 14*a* in sliding contact with the photoconductor drum 11 is reduced.

In FIG. 2, the image forming process described above will be described in more detail.

The developing roller 13*a* rotates in the direction of the arrow in FIG. 2. The developer Gin the developing device 13 circulates in the longitudinal direction (direction perpendicular to the surface of FIG. 2) while being agitated and mixed together with the toner T supplied from a toner supplier 30 via a toner supply port with the rotation in the direction of the arrow of the first conveying screw 13*b* and the second conveying screw 13*c* disposed via the partitioning member.

Then, the toner T frictionally charged and attracted by the carrier C is born on the developing roller 13*a* together with the carrier C. The developer G born on the developing roller 13*a* then reaches the position of the doctor blade 13*d*. Then, the developer G on the developing roller 13*a* is adjusted to an appropriate amount at the position of the doctor blade 13*d*, and then reaches a position (developing region) facing the photoconductor drum 11.

After that, in the developing region, the toner T in the developer G adheres to the electrostatic latent image formed on the surface of the photoconductor drum 11. Specifically, the toner T adheres to the latent image by an electric field formed by an potential difference (developing potential) between a latent image potential (exposure potential) of an image portion irradiated with the laser light L and a developing bias (about −500 V) applied to the developing roller 13*a*.

After that, most of the toner T adhering to the photoconductor drum 11 in the developing process is transferred onto the intermediate transfer belt 17. Then, the surface of the photoconductor drum 11 after the transfer is neutralized by the neutralization device, and the untransferred toner T adhering (remaining) on the surface of the photoconductor drum 11 is collected into the cleaning device 14 by the cleaning blade 14*a* and the cleaning brush roller 14*b*. After that, the surface of the photoconductor drum 11 after the cleaning process passes through the lubricant supply device 15, and the series of image forming processes is terminated.

Here, the toner supplier 30 provided in the body of the image forming apparatus 1 includes a replaceable toner bottle 31, and a toner hopper 32 to hold and rotationally drive the toner bottle 31 and supply a new toner T to the developing device 13. Further, the new toner T (yellow toner in FIG. 2) is accommodated in the toner bottle 31. Further, spiral protrusions are formed on an inner peripheral surface of the toner bottle 31.

Note that the new toner T in the toner bottle 31 is appropriately supplied into the developing device 13 through the toner supply port with consumption of the toner T (existing toner) in the developing device 13. Consumption of the toner Tin the developing device 13 is indirectly or directly detected by a magnetic sensor installed below the second conveying screw 13*c* of the developing device 13.

Hereinafter, the charging device 12, which is characteristic in the present embodiment, will be described in detail with reference to FIGS. 2 to 4 and the like.

In the present embodiment, the charging device 12 (charging unit) is attachably and detachably installed with respect to the body of the image forming apparatus 1.

Specifically, as described above, the charging device 12 is one of members constituting the process cartridge 10Y attachably and detachably installed with respect to the body of the image forming apparatus 1 (or movable at a position where maintenance can be performed). Then, the charging device 12 is attachably and detachably installed with respect to the process cartridge 10Y. Therefore, in a case of performing maintenance or replacement of the charging device 12, first, the process cartridge 10Y is moved from the body of the image forming apparatus 1 to the outside (or the position where maintenance can be performed), and then the charging device 12 is detached from the moved process cartridge 10Y. Then, the charging device 12 after the maintenance or replacement is attached to the process cartridge 10Y, and the process cartridge 10Y is attached to the body of the image forming apparatus 1. As described above, in the present embodiment, the charging device 12 is indirectly attached and detached with respect to the body of the image forming apparatus 1.

Figure 3A:
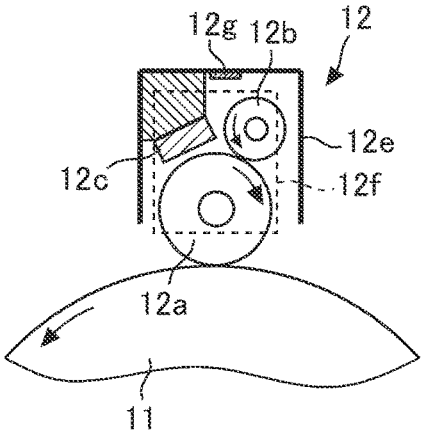
FIG. 3A is a schematic view illustrating a state in which a charging device is attached to a body of the image forming apparatus.
Figure 4A:
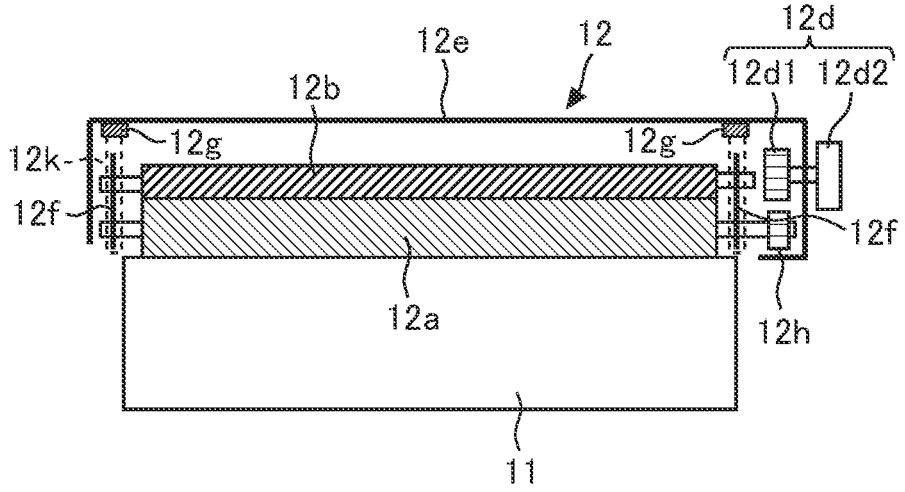
FIG. 4A is a schematic view illustrating, in a width direction, a state in which the charging device is attached to the body of the image forming apparatus.

Then, referring to FIGS. 3A, 4A, and the like, in the charging device 12 in the present embodiment, the charging roller 12*a*, the cleaning roller 12*b* as a first cleaning member, the cleaning pad 12*c* as a second cleaning member, the operating member 12*d*, the gear 12*h*, the casing 12*e*, the movable plate 12*f*, and the like are installed.

The charging roller 12*a* comes into contact with the photoconductor drum 11 (image bearer) and charges the photoconductor drum 11, and is rotatably held by the casing 12*e* (housing) of the charging device 12 via the movable plate 12*f* The gear 12*h* (used during detachment) that rotates together with the charging roller 12*a* is installed on a shaft of an end in a rotation axis direction of the charging roller 12*a*. The charging roller 12*a* co-rotates in the clockwise direction in FIG. 3A as the photoconductor drum 11 rotates in the arrow direction (counterclockwise direction) in FIG. 3A. That is, the charging roller 12*a* is rotatably held by the charging device 12 to co-rotate with the rotation of the photoconductor drum 11 installed in the process cartridge 10Y (the body of the image forming apparatus 1).

The cleaning roller 12*b* and the cleaning pad 12*c* function as cleaning members to clean the charging roller 12*a*. The charging roller 12*a* is apt to become dirty due to adhesion of foreign substances such as the toner and the lubricant, and such dirt causes abnormal images such as charging failure. The cleaning members are used to reduce occurrence of such abnormal images.

Figure 3B:
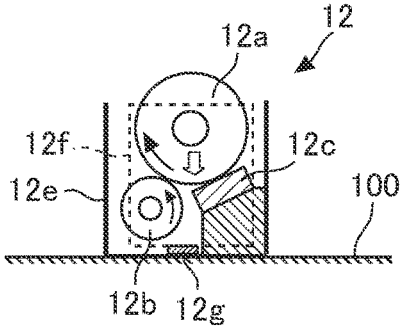
FIG. 3B is a schematic diagram illustrating a state in which the charging device is detached from the body of the image forming apparatus and left to stand on a floor surface.
Figure 4B:
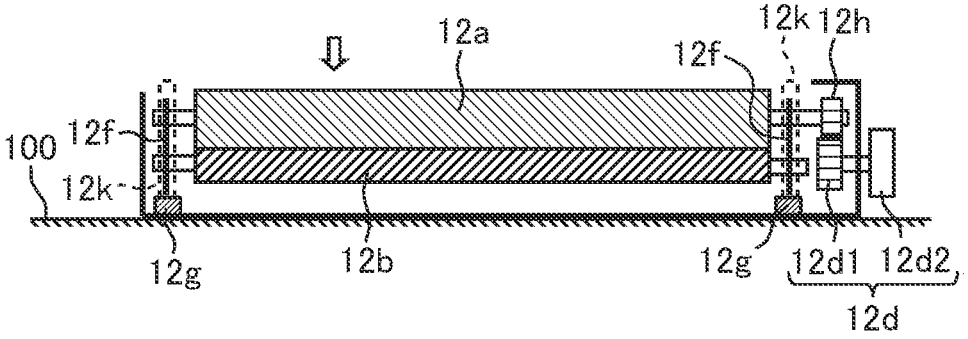
FIG. 4B is a schematic diagram illustrating, in the width direction, a state in which the charging device is detached from the body of the image forming apparatus and left to stand on a floor surface.

Here, the charging device 12 in the present embodiment is configured such that the cleaning members (the cleaning roller 12*b* and the cleaning pad 12*c*) have a higher cleaning performance on the charging roller 12*a* during detachment in which the charging device 12 is detached from the body of the image forming apparatus 1, as illustrated in FIGS. 3B and 4B than during attachment in which the charging device 12 is attached to the body of the image forming apparatus 1, as illustrated in FIGS. 2, 3A, and 4A.

That is, the degree of the charging roller 12*a* being cleaned by the cleaning members (the cleaning roller 12*b* and the cleaning pad 12*c*) during attachment illustrated in FIGS. 2, 3A, and 4A is smaller than the degree of the charging roller 12*a* being cleaned by the cleaning members (the cleaning roller 12*b* and the cleaning pad 12*c*) during detachment illustrated in FIGS. 3B and 4B. Therefore, in a case where the charging roller 12*a* gets very dirty, the charging roller 12*a* is sufficiently cleaned during detachment as compared with during attachment.

Specifically, the cleaning roller 12*b* as the first cleaning member is in contact with the charging roller 12*a* during attachment and during detachment on a constant basis. Then, the charging roller 12*a* and the cleaning roller 12*b* (first cleaning member) are movable in an up-down direction in a state of being in contact with each other in the charging device 12. Specifically, both end shaft portions of the charging roller 12*a* and the cleaning roller 12*b* are rotatably held by the movable plate 12*f* via bearings, respectively. The movable plate 12*f* is movably held in the up-down direction along a guide 12*k* (formed in the casing 12*e*) by the casing 12*e* of the charging device 12. The cleaning roller 12*b* is formed such that an elastic layer made of felt, foamed polyurethane, foamed melanin, or the like is formed on a shaft (cored bar), and comes into contact with the charging roller 12*a* to clean the surface of the charging roller 12*a*. The cleaning roller 12*b* co-rotates in the counterclockwise direction in FIG. 3A as the charging roller 12*a* rotates in the clockwise direction in FIG. 3A.

Meanwhile, the cleaning pad 12*c* as the second cleaning member is separated from the charging roller 12*a* during attachment, as illustrated in FIGS. 2, 3A, and 4A, and comes into contact with the charging roller 12*a* during detachment, as illustrated in FIGS. 3B and 4B. The cleaning pad 12*c*

(second cleaning member) is secured at a predetermined position of the charging device 12. The cleaning pad 12*c* is made of an elastic material such as felt, foamed polyurethane, or foamed melanin, and comes in sliding contact with the charging roller 12*a* to clean the surface of the charging roller 12*a*.

Specifically, the charging roller 12*a* moves together with the cleaning roller 12*b* (first cleaning member) to a lower position where the charging roller 12*a* is separated from the cleaning pad 12*c* (second cleaning member) at the time of attachment. In contrast, at the time of detachment and when the posture of the charging device 12 becomes upside down (a posture in which the up-down direction is inverted) with respect to the posture during attachment, the charging roller 12*a* moves together with the cleaning roller 12*b* (first cleaning member) to a lower position where the charging roller 12*a* comes into contact with the cleaning pad 12*c* (second cleaning member).

That is, the charging roller 12*a* is cleaned by the cleaning roller 12*b* during attachment, and the charging roller 12*a* is cleaned by the cleaning pad 12*c* in addition to the cleaning roller 12*b* during detachment. Therefore, the cleaning performance on the charging roller 12*a* during detachment can be made higher than the cleaning performance during attachment.

Note that, during detachment, when the operating member 12*d* described below is operated by an operator, the charging roller 12*a* is manually rotated, and the cleaning roller 12*b* cleans the charging roller 12*a* while co-rotating and the cleaning pad 12*c* cleans the charging roller 12*a* while being in sliding contact with the charging roller 12*a*.

With such a configuration, abrasion of the charging roller 12*a* and the cleaning members (the cleaning roller 12*b* and the cleaning pad 12*c*) less easily progresses, and the charging roller 12*a* can be efficiently cleaned by the cleaning members.

Specifically, in a case where a large amount of images having a partially high image area ratio is printed in a main scanning direction (width direction) during image formation, there are some cases where the surface of the charging roller 12*a* gets locally dirty. If the cleaning members are set to be brought into contact with the charging roller 12*a* with a high contact pressure in the state of being attached to the image forming apparatus 1, and to clean the charging roller 12*a* with uniformly high cleaning performance, assuming a state where the dirt on the surface of the charging roller 12*a* gets worse (an irregular state as compared with a normal use state) and on the basis of the assumed state, the abrasion of the charging roller 12*a* and the cleaning members is accelerated and the life of the members becomes short.

In contrast, in the present embodiment, the cleaning performance of the cleaning members during attachment is set to be relatively low, assuming that the dirt on the surface of the charging roller 12*a* is in a normal progress state, and on the basis of the assumed state. Specifically, in the present embodiment, the charging roller 12*a* is cleaned by the cleaning roller 12*b* without using the cleaning pad 12*c*.

Then, when the dirt on the surface of the charging roller 12*a* is in a bad progress state and cleaning with the cleaning performance of the cleaning roller 12*b* during attachment is insufficient, the charging device 12 is detached from the body of the image forming apparatus 1, and the charging roller 12*a* is cleaned (maintained) with higher cleaning performance than during attachment. Specifically, in the present embodiment, the cleaning of the charging roller 12*a* by the cleaning pad 12*c* is performed in addition to the cleaning of the charging roller 12*a* by the cleaning roller 12*b*. Therefore, the abrasion of the charging roller 12*a* and the cleaning members (the cleaning roller 12*b* and the cleaning pad 12*c*) does not wastefully progress, and the charging roller 12*a* can be efficiently cleaned by the cleaning members.

Note that the state where the dirt on the surface of the charging roller 12*a* gets worse can be determined by seeing an image formed on the sheet, or a potential sensor to detect a charged potential of the photoconductor drum 11 is installed and abnormality (occurrence of dirt beyond expectation) can be given in notification to a user from a detection result.

Here, the charging device 12 in the present embodiment can be left to stand on a horizontal plane (floor surface 100) including a substantially horizontal plane during detachment and at the posture upside down with respect to the posture during attachment, as illustrated in FIGS. 3B and 4B.

Then, the charging device 12 is provided with the operating member 12*d* capable of manually rotating the charging roller 12*a* during detachment.

Specifically, the operating member 12*d* mainly includes a manual operating portion 12*d*2 (gripper) and an operating gear 12*d*1, and can operate rotation of the charging roller 12*a* when the charging device 12 is detached from the body of the image forming apparatus 1 (process cartridge 10Y), as illustrated in FIG. 4B. The operating member 12*d* is rotatably held on a side surface on one side (a side where the gear 12*h* of the charging roller 12*a* is installed) of the casing 12*e*. The manual operating portion 12*d*2 and the operating gear 12*d*1 are coaxially installed. The manual operating portion 12*d*2 is installed to be exposed to a side of the charging device 12 (casing 12*e*) and the operating gear 12*d*1 is installed not to be exposed from the charging device 12 (casing 12*e*). The process cartridge 10Y can be left to stand on a substantially horizontal plane at the posture illustrated in FIG. 2 according to the shape of the case. Further, the operating member 12*d* (manual operating portion 12*d*2) is installed not to be exposed to the outside of the process cartridge 10Y in the state where the charging device 12 is attached to the process cartridge 10Y.

Then, in the present embodiment, when the charging device 12 is attached to the body of the image forming apparatus 1 (process cartridge 10Y), the charging roller 12*a* is not rotated even when the operating member 12*d* is operated. That is, the operating member 12*d* cannot operate the rotation of the charging roller 12*a* when the charging device 12 is attached to the body of the image forming apparatus 1 (process cartridge 10Y), and can operate the rotation of the charging roller 12*a* when the charging device 12 is detached from the body of the image forming apparatus 1 (process cartridge 10Y).

Then, the operating member 12*d* is coupled with the charging roller 12*a* (gear 12*h*) when the charging device 12 is detached from the body of the image forming apparatus 1 (process cartridge 10Y) and is turned upside down, as illustrated in FIG. 4B, and the coupling with the charging roller 12*a* (gear 12*h*) is released when the charging device 12 is attached to the body of the image forming apparatus 1 (process cartridge 10Y), as illustrated in FIG. 4A. Therefore, the operator such as the user cannot operate the rotation of the charging roller 12*a* even when manually operating the operating member 12*d* in the state where the charging device 12 is attached, and can manually operate the operating member 12*d* to operate the rotation of the charging roller 12*a* when the charging device 12 is detached.

More specifically, the charging device 12 is configured such that the charging roller 12*a* is in contact with the photoconductor drum 11 (image bearer) at a position above the photoconductor drum 11 (image bearer) when the charging device 12 is attached to the body of the image forming apparatus 1 (process cartridge 10Y). That is, in the attached state of the charging device 12, a part of the charging roller 12*a* is exposed below the casing 12*e* in the rotation axis direction and is in contact with the photoconductor drum 11 located below the charging roller 12*a*.

With such a configuration, a trouble caused by the operator erroneously manually rotating the operating member 12*d* (manual operating portion 12*d*2) to rotate the charging roller 12*a* in the state where the charging device 12 is attached, and damaging the photoconductor drum 11 can be prevented. In addition, workability of cleaning work on the charging roller 12*a* by the operator during detachment can be improved.

Here, the charging device 12 in the present embodiment is provided with a stopper 12*g* to restrict an amount of movement of the charging roller 12*a* moving downward together with the cleaning roller 12*b* (first cleaning member) during detachment and when the posture becomes upside down, as illustrated in FIGS. 3B and 4B.

Specifically, the stopper 12*g* is provided on a ceiling of the casing 12*e* (a ceiling at the posture during attachment). Then, when the posture of the charging device 12 is changed from the posture in FIGS. 3A and 4A to the posture in FIGS. 3B and 4B, the movable plate 12*f* holding the charging roller 12*a* and the cleaning roller 12*b* moves downward to a position butting against the stopper 12*g*, and the position is determined. This butting position is a position set so that the cleaning pad 12*c* is in contact with the charging roller 12*a* at a target contact pressure.

With such a configuration, the cleaning performance of the cleaning pad 12*c* can be optimized.

First Modification

Figure 5A:
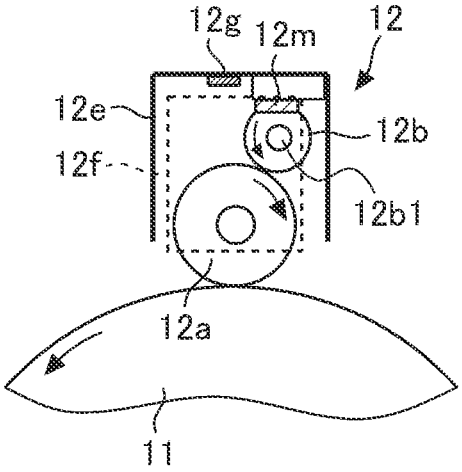
FIG. 5A is a schematic view illustrating a state in which a charging device as a first modification is attached to a body of an image forming apparatus.
Figure 5B:
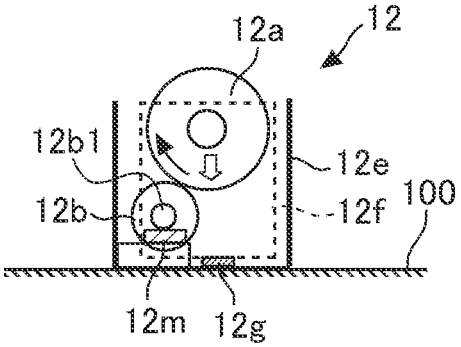
FIG. 5B is a schematic diagram illustrating a state in which the charging device is detached from the body of the image forming apparatus and left to stand on a floor surface.

FIG. 5A is a schematic view illustrating a state in which a charging device 12 as a first modification is attached to a body of an image forming apparatus 1 and FIG. 5B is a schematic diagram illustrating a state in which the charging device 12 is detached from the body of the image forming apparatus 1 and left to stand on a floor surface 100, and FIGS. 5A and 5B correspond to FIGS. 3A and 3B, respectively.

The charging device 12 in the first modification is different in using a cleaning roller 12*b* as a cleaning member from the present embodiment using the cleaning roller 12*b* and the cleaning pad 12*c* as the cleaning members.

The cleaning roller 12*b* is a rotatable roller member coming into contact with a charging roller 12*a*. Then, the cleaning roller 12*b* (cleaning member) in the first modification co-rotates with the rotation of the charging roller 12*a* during attachment, as illustrated in FIG. 5A, and does not rotate even when the charging roller 12*a* rotates during detachment, as illustrated in FIG. 5B.

Specifically, in the first modification, the charging roller 12*a* and the cleaning roller 12*b* are rotatably held by a movable plate 12*f*, and are movable in an up-down direction in a state of being in contact with each other in the charging device 12, similarly to the charging roller 12*a* and the cleaning roller 12*b* in the present embodiment.

Here, in the charging device 12 in the first modification, a braking member 12*m* is installed at a predetermined position (at a ceiling of a casing 12*e* illustrated in FIG. 5A). The braking member 12*m* is formed of a material having a large friction coefficient (for example, a rubber material).

Then, as illustrated in FIG. 5A, at the time of attachment, the cleaning roller 12*b* moves together with the charging roller 12*a* to a lower position where the cleaning roller 12*b* is separated from the braking member 12*m*. At this time, the cleaning roller 12*b* co-rotates with the rotation of the charging roller 12*a*, and cleans the charging roller 12*a* with relatively low cleaning performance (contact pressure).

In contrast, at the time of detachment and when the posture of the charging device 12 becomes upside down with respect to the posture during attachment, as illustrated in FIG. 5B, the cleaning roller 12*b* moves together with the charging roller 12*a* to a lower position where the cleaning roller 12*b* comes into contact with the braking member 12*m*. At this time, a shaft 12*b*1 of the cleaning roller 12*b* comes into contact with the braking member 12*m*, and the cleaning roller 12*b* does not rotate even when the charging roller 12*a* rotates due to frictional resistance against the braking member 12*m*, and cleans the charging roller 12*a* with relatively high cleaning performance (contact pressure).

Even with such a configuration, abrasion of the charging roller 12*a* and the cleaning roller 12*b* less easily progresses, and the charging roller 12*a* can be efficiently cleaned by the cleaning roller 12*b*.

Note that, in the first modification, a stopper 12*g* to restrict an amount of movement of the cleaning roller 12*b* moving downward together with the charging roller 12*a* at the time of detachment and when the posture is upside down is provided, as illustrated in FIG. 5B.

Specifically, the stopper 12*g* is provided on a ceiling of the casing 12*e* (a ceiling at the posture during attachment). Then, when the posture of the charging device 12 is changed from the posture in FIG. 5A to the posture in FIG. 5B, the movable plate 12*f* holding the charging roller 12*a* and the cleaning roller 12*b* moves downward to a position butting against the stopper 12*g*, and the position is determined. This butting position is a position set so that the cleaning roller 12*b* is in contact with the braking member 12*m* at a target contact pressure. With such a configuration, the cleaning performance of the cleaning roller 12*b* during detachment can be optimized.

Second Modification

Figure 6A:
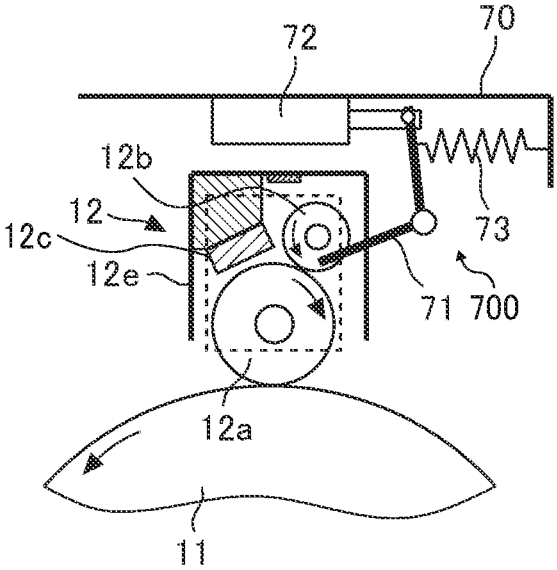
FIG. 6A is a schematic view illustrating a state during non-image formation.
Figure 6B:
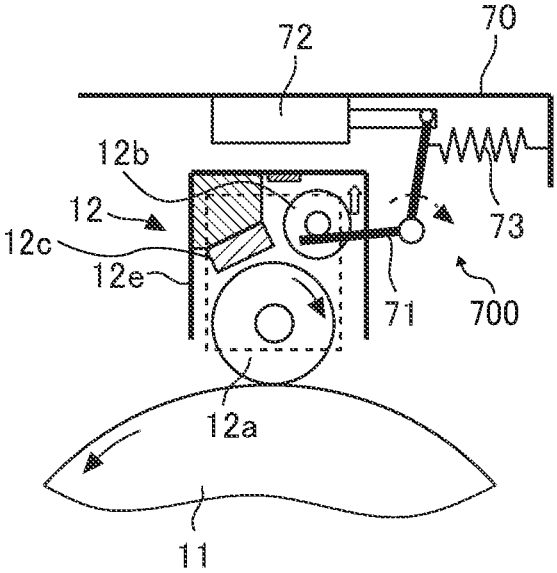
FIG. 6B is a schematic view illustrating a state during image formation in a state where a charging device as a second modification is attached to a body of an image forming apparatus.

FIG. 6A is a schematic view illustrating a state during non-image formation in a state in which a charging device 12 as a second modification is attached to a body of an image forming apparatus 1 and FIG. 6B is a schematic view illustrating a state during image formation during attachment, and both of FIGS. 6A and 6B correspond to FIG. 3A.

As illustrated in FIGS. 6A and 6B, in the second modification, the cleaning performance of the cleaning roller 12*b* (cleaning member) on the charging roller 12*a* during attachment is set to be higher during non-image formation than during image formation.

Specifically, a contact-and-separation mechanisms 700 to cause the cleaning roller 12*b* to come into contact with or to be separated from the charging roller 12*a* (or to increase or decrease a contact pressure) in a state where the charging device 12 is attached are installed in the body of the image forming apparatus 1. The contact-and-separation mechanism 700 includes a lever 71, a solenoid 72, a tension spring 73, and the like. The lever 71 is held on a top plate 70 to be rotatable about a spindle. A flanger (held by the top plate 70) of the solenoid 72 is coupled to an arm on one end side of the lever 71, and the tension spring 73 that urges the arm in an opposite direction to an attraction direction of the solenoid 72 is coupled to the lever 71.

Then, in the state where the charging device 12 is attached to the body of the image forming apparatus 1 (the contact-and-separation mechanism 700) during non-image formation (during a period where no charging process is performed such as during warming up or immediately after completion of an image forming process), the solenoid 72 is turned off (not energized), and the arm on the other end side of the lever 71 moves to a position away from the cleaning roller 12*b*, as illustrated in FIG. 6A. With the movement, the cleaning roller 12*b* is in contact with the charging roller 12*a*, and the charging roller 12*a* is cleaned by the cleaning roller 12*b* rotating with the charging roller 12*a*.

In contrast, during image formation (during a period where the charging process is performed), the solenoid 72 is turned on (energized), and the lever 71 rotates in a clockwise direction about the spindle, and the arm on the other end side of the lever 71 pushes up the cleaning roller 12*b*, as illustrated in FIG. 6B. With the operation, the cleaning roller 12*b* is separated from the charging roller 12*a*, and cleaning by the cleaning roller 12*b* is not performed.

In this manner, in the state where the charging device 12 is attached to the body of the image forming apparatus 1, the cleaning roller 12*b* is separated from the charging roller 12*a* (or the contact pressure is decreased) during image formation, whereas the cleaning is positively performed by the cleaning roller 12*b* during non-image formation, whereby abrasion of the charging roller 12*a* and the cleaning members (the cleaning roller 12*b* and the cleaning pad 12*c*) less easily progresses. Then, even in such a configuration, cleaning performance on the charging roller 12*a* can be enhanced by the cleaning members (the cleaning roller 12*b* and the cleaning pad 12*c*) when the charging roller 12*a* is detached, whereby an effect similar to the effect of the present embodiment can be obtained.

As described above, the charging device 12 in the present embodiment is configured such that the cleaning performance of the cleaning members (the cleaning roller 12*b* and the cleaning pad 12*c*) on the charging roller 12*a* becomes higher during detachment in which the charging device 12 is detached from the body of the image forming apparatus 1 than during attachment in which the charging device 12 is attached to the body of the image forming apparatus 1.

With such a configuration, the abrasion of the charging roller 12*a* and the cleaning members (the cleaning roller 12*b* and the cleaning pad 12*c*) less easily progresses, and the charging roller 12*a* can be efficiently cleaned by the cleaning members (the cleaning roller 12*b* and the cleaning pad 12*c*).

Note that, in the present embodiment, each of the process cartridges 10Y, 10M, 10C, and 10BK is configured by integrating the constituent members (the photoconductor drum 11, the charging device 12, the developing device 13, the cleaning device 14, and the lubricant supply device 15) in the image former, thereby to make the image former compact and improve the maintenance workability. In contrast, the charging device 12 can be made to a unit attachably and detachably installed with respect to the body of the image forming apparatus 1 alone in a direct manner, instead of being a constituent member of the process cartridge.

In the present application, the "process cartridge" is defined as a unit in which at least one of the charging device (charger) to charge the image bearer, the developing device to develop the latent image formed on the image bearer, and the cleaning device to clean the surface of the image bearer is integrated with the image bearer, and the integrated devices are attachably and detachably installed with respect to the body of the image forming apparatus.

Further, in the charging device 12 according to the present embodiment of the present disclosure, the charging roller 12*a* is in contact with the photoconductor drum 11 at a position above the photoconductor drum 11 when the charging device 12 is attached to the body of the image forming apparatus 1. Alternatively, in the charging device according to another embodiment, a charging roller may face a photoconductor drum with a gap at a position above the photoconductor drum when the charging device is attached to a body of an image forming apparatus.

Then, even in such a case, an effect similar to the effect of the present embodiment can be obtained.

Note that embodiments of the present disclosure are not limited to the above-described embodiments and it is obvious that the above-described embodiments can be appropriately modified within the scope of the technical idea of the present invention in addition to what is suggested in the present embodiment. In addition, the number, position, shape, material, and the like of the constituent members are not limited to the number, position, shape, material, and the like of the present embodiment, and can be changed to a suitable number, position, shape, material, and the like in implementing the present invention.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A charging device detachably attachable with respect to a body of an image forming apparatus, the charging device comprising:

a charging roller to charge an image bearer; and a cleaning member to clean the charging roller, the cleaning member having a higher cleaning performance on the charging roller during detachment in which the charging device is detached from the body of the image forming apparatus than during attachment in which the charging device is attached to the body of the image forming apparatus, wherein the cleaning member includes:

a first cleaning member being in contact with the charging roller during both the attachment and the detachment, and a second cleaning member being separated from the charging roller during the attachment and in contact with the charging roller during the detachment.

2. The charging device according to claim 1, wherein the charging roller and the first cleaning member are movable in a vertical direction in a state in which the charging roller and the first cleaning member are in contact with each other in the charging device, wherein the second cleaning member is secured at a predetermined position of the charging device, wherein, during the attachment, the charging roller moves downward together with the first cleaning member to a position at which the charging roller is separated from the second cleaning member, and wherein during the detachment and when a posture of the charging device becomes upside down with respect to a posture during the attachment, the charging roller moves downward together with the first cleaning member to a position at which the charging roller contacts the second cleaning member.

3. The charging device according to claim 2, further comprising a stopper to restrict an amount of movement of the charging roller moving downward together with the first cleaning member during the detachment and when the posture becomes upside down.

4. The charging device according to claim 1, wherein the cleaning member is a rotatable cleaning roller to contact the charging roller and rotate with rotation of the charging roller during the attachment, wherein the cleaning roller does not rotate with rotation of the charging roller during the detachment.

5. The charging device according to claim 4, further comprising a braking member secured at a predetermined position of the charging device, wherein the charging roller and the cleaning roller are movable in a vertical direction in a state in which the charging roller and the cleaning roller are in contact with each other in the charging device, wherein, during the attachment, the cleaning roller moves downward together with the charging roller to a position at which the cleaning roller is separated from the braking member, and wherein, during the detachment and when a posture of the charging device becomes upside down with respect to a posture during the attachment, the cleaning roller moves downward together with the charging roller to a position at which the cleaning roller contacts the braking member.

6. The charging device according to claim 5, further comprising a stopper to restrict an amount of movement of the cleaning roller moving downward together with the charging roller during the detachment and when the posture becomes upside down.

7. The charging device according to claim 1, wherein, during the attachment, the cleaning member has a higher cleaning performance on the charging roller during non-image formation than during image formation.

8. The charging device according to claim 1, wherein the charging device is configured to stand on a horizontal plane during the detachment such that a posture of the charging device is upside down with respect to a posture during the attachment.

9. The charging device according to claim 1, further comprising an operating member to manually rotate the charging roller during the detachment.

10. A process cartridge detachably attached with respect to the body of the image forming apparatus, the process cartridge comprising:

the charging device according to claim 1; and the image bearer.

11. An image forming apparatus comprising the charging device according to claim 1.

12. A charging device detachably attachable with respect to a body of an image forming apparatus, the charging device comprising:

a charging roller to charge an image bearer; and a cleaning member to clean the charging roller, the cleaning member having a higher cleaning performance on the charging roller during detachment in which the charging device is detached from the body of the image forming apparatus than during attachment in which the charging device is attached to the body of the image forming apparatus, wherein the cleaning member is a rotatable cleaning roller to contact the charging roller and rotate with rotation of the charging roller during the attachment, and wherein the cleaning roller does not rotate with rotation of the charging roller during the detachment.

13. The charging device according to claim 12, further comprising a braking member secured at a predetermined position of the charging device, wherein the charging roller and the cleaning roller are movable in a vertical direction in a state in which the charging roller and the cleaning roller are in contact with each other in the charging device, wherein, during the attachment, the cleaning roller moves downward together with the charging roller to a position at which the cleaning roller is separated from the braking member, and wherein, during the detachment and when a posture of the charging device becomes upside down with respect to a posture during the attachment, the cleaning roller moves downward together with the charging roller to a position at which the cleaning roller contacts the braking member.

14. The charging device according to claim 13, further comprising a stopper to restrict an amount of movement of the cleaning roller moving downward together with the charging roller during the detachment and when the posture becomes upside down.

15. A charging device detachably attachable with respect to a body of an image forming apparatus, the charging device comprising:

a charging roller to charge an image bearer; and a cleaning member to clean the charging roller, the cleaning member having a higher cleaning performance on the charging roller during detachment in which the charging device is detached from the body of the image forming apparatus than during attachment in which the charging device is attached to the body of the image forming apparatus, wherein the charging device is configured to stand on a horizontal plane during the detachment such that a posture of the charging device is upside down with respect to a posture during the attachment.

16. A charging device detachably attachable with respect to a body of an image forming apparatus, the charging device comprising:

a charging roller to charge an image bearer; and a cleaning member to clean the charging roller, the cleaning member having a higher cleaning performance on the charging roller during detachment in which the charging device is detached from the body of the image forming apparatus than during attachment in which the charging device is attached to the body of the image forming apparatus, wherein the charging device further comprises an operating member to manually rotate the charging roller during the detachment.

* * * * *